US008847090B2

(12) United States Patent
Ozaki

(10) Patent No.: US 8,847,090 B2
(45) Date of Patent: Sep. 30, 2014

(54) SWITCH MODULE

(75) Inventor: Kazuyuki Ozaki, Tokyo (JP)

(73) Assignee: Nippon Mektron, Ltd., Tokyo (JP)

( * ) Notice: Subject to any disclaimer, the term of this patent is extended or adjusted under 35 U.S.C. 154(b) by 239 days.

(21) Appl. No.: 12/904,211

(22) Filed: Oct. 14, 2010

(65) Prior Publication Data

US 2011/0089011 A1 Apr. 21, 2011

(30) Foreign Application Priority Data

Oct. 15, 2009 (JP) ..... 2009-238155

(51) Int. Cl.

| | |
|---|---|
| ***H01H 9/00*** | (2006.01) |
| ***H01H 13/85*** | (2006.01) |
| ***H01H 13/88*** | (2006.01) |
| ***H01H 13/83*** | (2006.01) |

(52) U.S. Cl.

CPC ..... *H01H 13/83* (2013.01); *H01H 2219/062* (2013.01); *H01H 13/85* (2013.01); *H01H 2227/004* (2013.01); *H01H 13/88* (2013.01); *H01H 2209/03* (2013.01); *H01H 2229/004* (2013.01); *H01H 2215/036* (2013.01); *H01H 2201/018* (2013.01); *H01H 2219/044* (2013.01); *H01H 2209/038* (2013.01); *H01H 2227/036* (2013.01); *H01H 2219/06* (2013.01)

USPC ..... 200/314

(58) Field of Classification Search

CPC .. G02B 6/0065; G02B 6/0076; G02B 6/0061; G02B 6/005; G02B 6/0016; G02B 6/0018; H01H 13/83

USPC ..... 200/512; 362/23

See application file for complete search history.

(56) References Cited

U.S. PATENT DOCUMENTS

| | | | | |
|---|---|---|---|---|
| 5,669,486 | A * | 9/1997 | Shima | 200/314 |
| 7,891,829 | B2 * | 2/2011 | Takeda et al. | 362/85 |
| 7,952,043 | B2 * | 5/2011 | Lin | 200/310 |
| 7,994,445 | B2 * | 8/2011 | Aihara et al. | 200/314 |
| 2007/0068784 | A1 | 3/2007 | Sellers | |
| 2007/0279932 | A1 | 12/2007 | Ishihara et al. | |
| 2009/0050456 | A1 | 2/2009 | Kim et al. | |
| 2010/0038225 | A1 * | 2/2010 | Furuoya | 200/314 |
| 2010/0108481 | A1 * | 5/2010 | Chiang | 200/310 |
| 2010/0147660 | A1 | 6/2010 | Lin | |
| 2010/0252405 | A1 * | 10/2010 | Chen | 200/314 |
| 2010/0258419 | A1 * | 10/2010 | Chung et al. | 200/314 |

FOREIGN PATENT DOCUMENTS

| | | |
|---|---|---|
| CN | 1917113 A | 2/2007 |
| CN | 101331569 A | 12/2008 |
| JP | S6264905 U | 4/1987 |
| JP | HEI 03(1991)-117275 | 12/1991 |

(Continued)

*Primary Examiner* — Edwin A. Leon
*Assistant Examiner* — Lheiren Mae Caroc
(74) *Attorney, Agent, or Firm* — Harness, Dickey & Pierce, P.L.C.

(57) ABSTRACT

A switch module including a light source element is provided that obtains slimming down and a sufficient click feeling and suitably irradiates a key portion, while suppressing manufacturing cost. A switch module is disposed to face a key portion. The switch module includes a transparent FPC board, a transparent conductive film, an electrode, a metal dome which is in contact with a part of the transparent conductive film and which is allowed to come into contact with the electrode by being deformed, and an LED. Light emitted from the LED and guided in a direction orthogonal to a thickness direction of the board in the transparent FPC board is reflected by a reflecting portion provided on the transparent FPC board, in a direction of the key portion.

8 Claims, 4 Drawing Sheets

(56) References Cited

FOREIGN PATENT DOCUMENTS

| | | | |
|---|---|---|---|
| JP | H1139984 | A | 2/1999 |
| JP | 2003-308752 | A | 10/2003 |
| JP | 2004-022378 | | 1/2004 |
| JP | 2004-356028 | A | 12/2004 |
| JP | 2007-324100 | | 12/2007 |
| JP | 2008-181862 | | 8/2008 |
| JP | 2009-252527 | A | 10/2009 |
| TW | M352722 | U | 3/2009 |

* cited by examiner

SWITCH MODULE

BACKGROUND OF THE INVENTION

1. Field of the Invention

The present invention relates to a switch module used for key portions of portable devices such as mobile phones and notebook PCs.

2. Description of the Related Art

In recent years, it has been often seen that portable devices such as mobile phones and notebook PCs have a configuration in which LEDs (Light Emitting Diodes) are provided, as light source elements, on a board of a switch module disposed to face the back side of key portions. By thus providing the LEDs on the board of the switch module, light can be suitably irradiated onto a part of the key portions where light irradiation is required, from the switch module side. Furthermore, in recent years, a configuration is proposed in which a light guide plate is provided between key portions and a board of a switch module and light emitted from LEDs is guided to the light guide plate, whereby light is suitably irradiated onto a plurality of key portions. With this configuration, by combining the LEDs and the light guide plate, the number of LEDs can be reduced, enabling to achieve a reduction in manufacturing cost and power consumption.

Now, with reference to FIGS. 4A and 4B, a schematic configuration of a conventional switch module in which LEDs and a light guide plate are combined will be described. FIG. 4A is a schematic cross-sectional view of a conventional switch module and FIG. 4B is a schematic diagram showing the operation of a switch member 102 configured to be deformable. As shown in the drawings, in the conventional switch module, aboard 100 is provided in a position where the board 100 faces key portions 110. The board 100 is provided with wiring lines 101, electrodes 103, and metal domes 102 serving as switch members that cover their corresponding electrodes 103.

In addition, a dome sheet 105 serving as a protective member that mechanically protects the metal domes 102 is provided on surfaces of the metal domes 102. Alight guide plate 104 that guides light emitted from an LED 120 is provided between the dome sheet 105 and the key portions 110. Note that the light guide plate 104 is formed of acrylic, polycarbonate, or silicon rubber, and in portions of the light guide plate 104 that allow light to be reflected in a direction of the key portions 110, projections and recesses (reflecting portions) are formed by dot printing, a heat treatment, cutting processing, etc.

With this configuration, by a key portion 110 moving downward in FIG. 4A and a corresponding key top 110*a* thereby coming into contact by pressure with a corresponding metal dome 102, with the light guide plate 104 and the dome sheet 105 being sandwiched therebetween, the metal dome 102 is deformed and thus a part of the metal dome 102 comes into contact with a corresponding electrode 103. As a result, a corresponding wiring line 101 is electrically connected to the electrode 103 through the metal dome 102. This state is shown in FIG. 4B. Note that in FIG. 4B the light guide plate 104 and the dome sheet 105 are omitted for easy description of the operation of the metal dome 102.

However, the conventional switch module has the following problems.

<Problem 1: Difficulty in Slimming Down>

In recent years, there has been an increasing demand for slimming down and an improvement in design of portable devices. To meet the demand, a switch module needs to be slimmed down. However, in the configuration of the above-described conventional switch module, since the light guide plate 104 and the dome sheet 105 are provided between the key portions 110 and the board 100, it is difficult to slim down the switch module.

<Problem 2: Insufficient Click Feeling>

In general, in a portable device having key portions, the key portions are required to have a sufficient click feeling. The sensitivity of click feeling can be converted into numbers by "click rate (%)". Namely, the higher the "click rate (%)" is, the more sufficient click feeling is obtained. FIG. 3B shows the definition of the "click rate (%)". When the key portion is depressed (when the stroke of the key portion increases), a load on the key portion also increases to deform the switch member. When the load reaches a certain value, the switch member starts to be deformed. The load obtained at this time is F1. When the load reaches F1, thereafter, while the switch member is deformed, the key portion moves. Thus, with an increase in the stroke of the key portion, the load decreases. The minimum load obtained at this time is F2. Using F1 and F2 described here, the click rate is defined such that "click rate (%)=(F1−F2)/F1×100".

In the configuration of the above-described conventional switch module, since the light guide plate 104 and the dome sheet 105 are provided between the key portions 110 and the board 100, the "click rate (%)" decreases accordingly, and thus, a sufficient click feeling cannot be obtained. Hence, user's error operation and a reduction in operability are caused.

<Problem 3: Increase in Cost>

In the configuration of the above-described conventional switch module, since the light guide plate 104 for guiding light emitted from the LED 120 is required, the number of components of the switch module increases and also an assembly process becomes complex. As a result, an increase in manufacturing cost is brought about. To cope with the above-described problem of click feeling, for example, measures of providing projections on the surfaces of the light guide plate 104 and the metal domes 102 may be considered. However, in this case, too, since special processing is required to provide the projections, an increase in manufacturing cost is brought about.

Note that although there is disclosed, as one conventional art, a configuration of a membrane switch including a lighting display unit, in this case, since members corresponding to the above-described metal domes are not provided, a sufficient click feeling cannot be obtained. In addition, since a technique in which electric circuit parts are insert-molded using a transparent resin, etc., is used, it is difficult to slim down a switch module. In addition, although there is disclosed, as another conventional art, a technique in which a membrane switch having a polydome sheet is formed using a transparent FPC (Flexible Printed Circuit) having light transmittance, since a light guide plate is provided below a switch sheet, a switch module cannot be slimed down.

SUMMARY OF THE INVENTION

An object of the present invention is therefore to provide a switch module including a light source element, which is capable of achieving sliming down and a sufficient click feeling and suitably irradiating key portions, while suppressing manufacturing cost.

To attain the above-described object, the present invention is directed to a switch module disposed to face a key portion, the switch module including a board disposed to face the key portion, a wiring line formed on a side of the board that faces the key portion, an electrode provided on the side of the board that faces the key portion, a conductive switch member that is in contact with a part of the wiring line on the board and that is allowed to come into contact with the electrode by being deformed, and a light source element that emits light, the electrode and the wiring line being electrically connected to each other by the key portion coming into contact by pressure with the switch member and the switch member being thereby deformed to come into contact with the electrode, wherein the board is formed of a transparent material, and light emitted from the light source element and guided in a direction orthogonal to a thickness direction of the board in the board is reflected by a reflecting portion provided on the board, in a direction of the key portion.

With this configuration, since the board is formed of a transparent material, after light emitted from the light source element is guided in a direction orthogonal to a thickness direction of the board in the board, the light can be reflected in a direction of the key portion. Accordingly, since a light guide plate for guiding light does not need to be provided between the key portion and the board, slimming down and a reduction in the manufacturing cost of the switch module can be achieved. In addition, compared with the configuration in which a light guide plate is provided, since the number of components interposed between the key portion and the board is reduced, a click feeling can be improved.

Further, there is provided the switch module, wherein the board has flexibility, and the wiring line is a transparent wiring line formed on the board by a printing method.

With this configuration, since the board has flexibility, the board can be prevented from being deformed or damaged with repeated contact of the key portion by pressure with the switch member, and thus, the durability of the switch module can be improved. In addition, since the wiring line is transparent, light reflected from the board is not blocked by the wiring line. Accordingly, without causing a reduction in the amount of light, the key portion can be suitably irradiated and the number of light source elements can be reduced, and thus, a reduction in manufacturing cost and power consumption can be achieved.

Furthermore, since the transparent wiring line is formed by a printing method on the board having flexibility, the flexibility of the wiring line is improved. Even if the board is bending-deformed, there is no possibility that the wiring line is broken or comes off. In addition, since the wiring line is formed by a printing method which is a relatively low-cost processing method, a further reduction in manufacturing cost can be achieved.

Further, there is provided the switch module, wherein on the board, the wiring line is covered with a transparent protective member.

With this configuration, the wiring line can be mechanically protected from contact, shock, etc., by the protective member and thus the durability of the switch module is improved. In addition, since the protective member is transparent, there is no possibility that light reflected from the board is blocked by the protective member. Accordingly, without causing a reduction in the amount of light, the key portion can be suitably irradiated and the number of light source elements can be reduced, and thus, a reduction in manufacturing cost and power consumption can be achieved.

Further, there is provided the switch module, wherein the switch member is formed of a deformable transparent member where a transparent wiring line which is connected to a part of the wiring line is formed.

With this configuration, since the switch member and the wiring line formed on the switch member are transparent, light reflected from the board is not blocked by the switch member. Accordingly, without causing a reduction in the amount of light, the key port ion can be suitably irradiated and the number of light source elements can be reduced, and thus, a reduction in manufacturing cost and power consumption can be achieved.

Further, there is provided the switch module, wherein on the board, at least a side of the switch member that faces the key portion is covered with a transparent protective member.

With this configuration, the switch member which is deformed by the key portion coming into contact by pressure therewith can be mechanically protected. Hence, the durability of the switch module is improved. In addition, since the protective member is transparent, there is no possibility that light reflected from the board is blocked by the protective member. Accordingly, without causing a reduction in the amount of light, the key portion can be suitably irradiated and the number of light source elements can be reduced, and thus, a reduction in manufacturing cost and power consumption can be achieved. Note that the protective member may be configured to cover not only the switch member but also the entire surface of the board on the side facing the key portion. Therefore, the durability of the switch module can be further enhanced.

Further, there is provided the switch module, wherein the light source element emits light in the thickness direction of the board from a front surface of the board, and reflection processing is performed on the board to allow the light emitted from the light source element to be reflected in the direction orthogonal to the thickness direction of the board.

With this configuration, light emitted from the light source element can be efficiently guided into the board. For example, when light is guided into the board from a side surface of the board (in a direction orthogonal to a width direction), all of the light emitted from the light source element does not always enter the board, depending on the relative position of the board to the light source element or the thickness of the board. Thus, there is a possibility that light incidence efficiency (the ratio of light having entered the board to the emitted light) decreases. On the other hand, with the above-described configuration, since light emitted from the light source element is allowed to enter the board once from the front surface of the board and then the direction in which the light travels is changed in the board, the light can be efficiently guided into the board, enabling to achieve a reduction in manufacturing cost and power consumption.

Further, there is provided the switch module, wherein the light source element is provided on a different board than the board.

With this configuration, the relative position of the light source element to the board can be easily adjusted upon assembling the switch module. Accordingly, a reduction in yield caused by mounting tolerances can be absorbed and thus a reduction in manufacturing cost can be achieved.

As such, according to the present invention, a switch module including a light source element can be provided which is capable of achieving slimming down and a sufficient click feeling and suitably irradiating a key portion, while suppressing manufacturing cost.

DETAILED DESCRIPTION OF THE EMBODIMENTS

Embodiments for implementing the present invention will be illustratively described in detail below with reference to the drawings. Note that, for the dimensions, materials, shapes, relative disposition, etc., of components described in the following embodiments, the scope of the present invention is not intended to be limited thereto, unless otherwise particularly specified.

[First Embodiment]

Figure 1A:
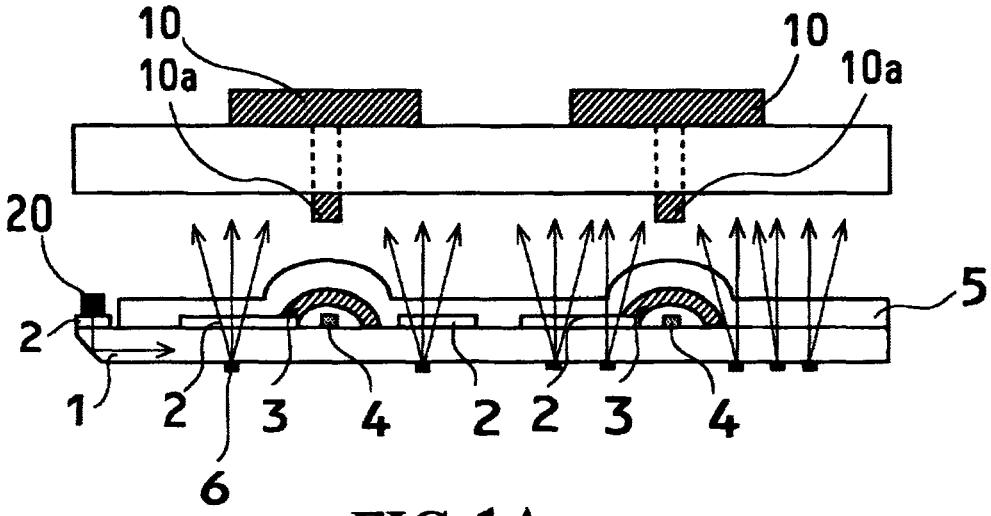
FIGS. 1A and 1B are schematic cross-sectional views of switch modules according to first and second embodiments of the present invention.

A switch module according to a first embodiment of the present invention will be described with reference to FIG. 1A. FIG. 1A is a schematic cross-sectional view of a switch module according to the present embodiment.

<1-1: Schematic Configuration of the Switch Module>

The switch module according to the present embodiment includes a transparent FPC (Flexible Printed Circuit) board 1 serving as a board; and an LED 20 serving as a light source element. The transparent FPC board 1 is disposed to face key portions 10. In addition, transparent conductive films 2 (wiring lines) and electrodes 4 are provided on a side of the transparent FPC board 1 that faces the key portions 10. Furthermore, each electrode 4 is covered with a deformable metal dome 3 (conductive switch member) which is in contact with a part of a corresponding transparent conductive film 2. In addition, at least the surfaces of the metal domes 3 are covered with a transparent dome sheet 5 (protective member). Note that the dome sheet 5 is attached to the metal domes 3 with an adhesive.

With this configuration, by a key portion 10 moving and a corresponding key top 10*a* thereby coming into contact by pressure with a corresponding metal dome 3 from above the dome sheet 5, the metal dome 3 is deformed in a concave manner and an inner surface of the metal dome 3 comes into contact with a corresponding electrode 4. Then, a corresponding transparent conducive film 2 is electrically connected to the electrode 4. Meanwhile, when the key portion 10 returns to its original state, the contact by pressure between the key top 10*a* and the metal dome 3 is released and the metal dome 3 returns to its original shape. As a result, the electrical connection between the transparent conductive film 2 and the electrode 4 is released. For the material of the metal dome 3, stainless steel is used but other metal materials may be used as long as the materials are deformable and conductive and satisfy durability. The main members described here will be described below.

<1-2: Transparent FPC Board>

In the present embodiment, a film member with a thickness of the order of about 100 μm is used as the transparent FPC board 1. Materials usable for the film member include transparent and flexible materials such as PET (polyethylene terephthalate), PEN (polyethylene naphthalate), and polycarbonate. In addition, transparent polyimide has been developed in recent years and can also be used. In a manufacturing process, these materials may be appropriately selected in view of heat resistance, durability, cost, etc. Note that the term "transparent" as used herein does not necessarily mean "clear and colorless" and may include the meaning of "clear and colored" provided that there is a predetermined light transmittance or more.

As such, in the present embodiment, since the transparent FPC board 1 is used as the board of the switch module, light can be guided into the board. Namely, since the transparent FPC board 1 not only has a function as a board but also has a light guiding function, a light guide plate does not need to be provided separately from the board, as does the conventional case. Thus, since a light guide plate does not need to be provided between the transparent FPC board 1 and the key portions 10, the switch module can be slimmed down.

In addition, a plurality of reflecting portions 6 is formed on a back surface of the transparent FPC board 1 (a surface of the transparent FPC board 1 on the opposite side to the side facing the key portions 10). Thus, light guided in a direction (arrow direction in the drawing) orthogonal to a thickness direction of the board 1 in the transparent FPC board 1 is irregularly reflected by the reflecting portions 6 in a direction of the key portions 10. Note that the term "orthogonal" as used herein does not mean precise "orthogonal"; the direction does not need to be a precise "orthogonal direction" (hereinafter, referred to as "substantially orthogonal") provided that the direction is one in which light travels towards where the plurality of reflecting portions 6 are formed. In the present embodiment, the reflecting portions 6 are formed by dot-printing a white pigment on the transparent FPC board 1. By using a UV-curing ink upon dot printing, the drying time can be reduced and thus the formation speed of the reflecting portions 6 can be increased. Note that the method of forming the reflecting portions 6 is not limited thereto. For example, a method may be used in which projections and recesses are formed on the back surface of the transparent FPC board 1 by a heat treatment or cutting processing.

Furthermore, in the present embodiment, the plurality of reflecting portions 6 provided on the back surface of the transparent FPC board 1 are configured such that the further the distance from the LED 20 is, the narrower the spacing between adjacent reflecting portions 6 is. With this configuration, even in a region where the amount of light decreases due to light attenuation (region where the distance from the LED 20 is far away), by increasing the number of reflecting portions 6 per unit region, the key portions 10 can be irradiated with a sufficient amount of light. Namely, even when light needs to be irradiated onto a plurality of key portions 10, these key portions 10 can be uniformly irradiated, independent of the distance from the LED 20.

Note that in the present embodiment since a flexible material is used as a material of the board, even when the key portions 10 repeatedly come into contact by pressure with the switch module, the transparent FPC board 1 is bending-deformed, and thus, the switch module can be prevented from being deformed or broken. However, a board usable in the present invention does not necessarily limited to a flexible board, and a material that does not have flexibility may also be used as long as the material has light transmittance and sufficient durability.

<1-3: Method of Forming Transparent Conductive>Films

In the present embodiment, the transparent conductive films 2 are formed on the transparent FPC board 1, as wiring lines. More specifically, by forming a paste-like ITO which is formed by mixing an organic material into ITO (Indium Tin Oxide), on the transparent FPC board 1 by a printing method, the transparent conductive films 2 having a function as wiring lines are formed.

Note that, for a method of forming wiring lines, a technique has been conventionally known in which ITO is deposited on a transparent plastic such as PET and the deposited ITO is pattern etched in any shape, whereby wiring lines are formed on the board. However, in this case, depending on the degree of bending of the board, the wiring lines may not be able to follow the bending deformation of the board and thus may be broken. In addition, even if the curvature of bending is large, when the number of bendings of the board increases, a problem that the wiring lines come off the board occurs. That is, even if a transparent board is used, the wiring lines on the board have problems such as breakage and coming off, and thus, conventional art cannot be applied to a switch module.

On the other hand, in the present embodiment, the transparent conductive films 2 are formed on the transparent FPC board 1 by a printing method and are used as wiring lines. According to the earnest studies of the inventors, it has been confirmed that compared with wiring lines formed by pattern etching deposited ITO, the wiring lines formed in the above-described manner have flexibility and follow the bending deformation of the board. Namely, according to the present embodiment, even if the transparent FPC board 1 is bending-deformed, it is unlikely that the transparent conductive films 2 are broken or come off, and thus, such a transparent FPC board 1 can be used as a switch module. In addition, compared with a pattern etching method, a wiring line formation method by a printing method can be said to be a processing method which is low in processing cost and is also low in environmental load.

The film thickness of the transparent conductive films 2 is appropriately set according to the application. Specifically, when the film thickness is increased, the light transmittance decreases while the electrical resistance value of the transparent conductive films 2 decreases (the amount of current increases). On the other hand, when the film thickness is reduced, the light transmittance increases while the electrical resistance value of the transparent conductive films 2 increases (the amount of current decreases). Namely, when importance is placed on the amount of current flowing through the circuits on the board, the film thickness is increased. When importance is placed on the light transmittance, the film thickness is reduced.

As such, according to the present embodiment, since the wiring lines are transparent, there is no possibility that light emitted from the LED 20 and reflected by the reflecting portions 6 is blocked by the wiring line portions. Thus, even if the number of LEDs 20 is reduced, the key portions 10 can be suitably irradiated, enabling to suppress power consumption. Note that although in the present embodiment the transparent conductive films 2 are used as wiring lines, the configuration of wiring lines applicable to the present invention is not limited thereto. Specifically, conventionally used copper foil, etc., may be used as wiring lines. In this case, although the amount of transmitted light decreases over the transparent conductive films 2, by devising the location, thinness, etc., of the wiring lines, the key portions 10 can be irradiated at a satisfactory irradiation level. Note that the electrodes 4 in the present embodiment can also be formed of the above-described transparent conductive films.

<1-3: LED>

In the present embodiment, the LED 20 is used as a light source element. The LED 20 is provided near an end of the transparent FPC board 1, and emits light in the thickness direction of the board 1 from a front surface of the transparent FPC board 1. Light having entered the transparent FPC board 1 in this manner is reflected by portions in the transparent FPC board 1 where mirror processing (reflection processing) is performed, and is guided in a direction substantially orthogonal to the thickness direction of the transparent FPC board 1. With this configuration, since substantially all of the light emitted from the LED 20 can be allowed to enter the transparent FPC board 1, the LED 20 can be positioned relatively roughly with respect to the transparent FPC board 1, enabling to reduce manufacturing cost. Note that although in the present embodiment, as shown in the drawing, one LED 20 is provided, the number of LEDs 20 is not limited thereto. Note also that although here the case is described in which the LED 20 emits light in the thickness direction of the board 1 from the front surface of the transparent FPC board 1, the disposition of the LED 20 is not limited thereto; as long as positioning is performed with high accuracy with respect to the transparent FPC board 1, the LED 20 may be disposed such that light enters from a side surface of the transparent FPC board 1.

<1-4: Comparison Between Click Rates>

According to the present embodiment, since the transparent FPC board 1 has the light guiding function, a light guide plate does not need to be interposed between the board 1 and the key portions 10, as does the conventional case. Thus, compared with the conventional configuration, the click feeling for when the key portions 10 are pressed can be improved. The following table shows the results of measuring the above-described "click rate" for a) when nothing is interposed between a metal dome and a key top, b) the conventional structure (when a light guide plate and a dome sheet are interposed), and c) the structure in the present embodiment (when only the dome sheet 5 is interposed).

TABLE 1

(Results of measurement of the click rate)
Click rate (%)

| | click rate (%) |
|---|---|
| a) When nothing is interposed | 55% |
| b) Conventional structure | 45% |
| c) Present embodiment | 50% |

Figure 4A:
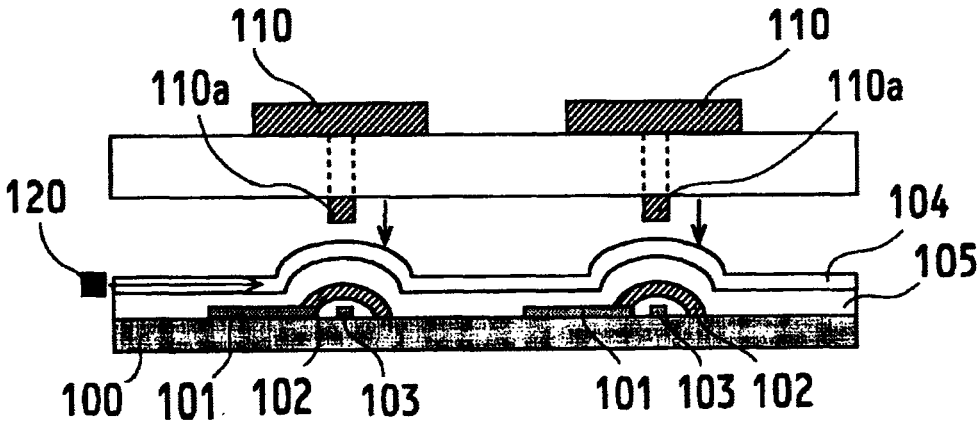
FIGS. 4A and 4B are schematic cross-sectional views of a conventional switch module.
Figure 4B:
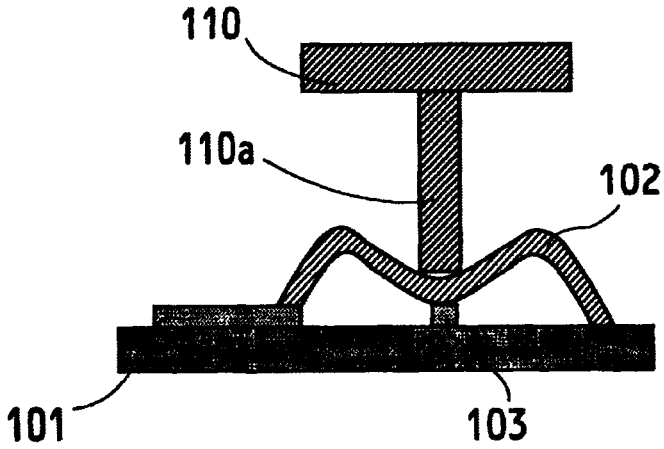

As such, according to the present embodiment, since a light guide plate is not interposed between the board 1 and the key portions 10, the click rate can be improved over the conventional structure shown in FIG. 4A. Namely, a sufficient click feeling can be achieved without the need for any special processing.

<1-5: Effects of the Present Embodiment>

As described above, according to the switch module of the present embodiment, since the transparent FPC board 1 is used as a board, light emitted from the LED 20 can be guided into the transparent FPC board 1 and thus a light guide plate does not need to be provided between the board 1 and the key portions 10. Accordingly, the key module can be slimmed down and a sufficient click feeling can be achieved.

In addition, since the wiring lines on the transparent FPC board 1 are formed of the transparent conductive films 2 which are formed by a printing method, and the dome sheet 5 is also transparent, even if the number of LEDs 20 is reduced, the key portions 10 can be suitably irradiated. Accordingly, a reduction in manufacturing cost and power consumption can be achieved.

In addition, the LED 20 emits light in the thickness direction of the board 1 from the front surface of the transparent FPC board 1, and light having entered the transparent FPC board 1 is reflected by portions in the transparent FPC board 1 where mirror processing (reflection processing) is performed, and is guided in a direction substantially orthogonal to the thickness direction of the transparent FPC board 1.

Thus, substantially all of the light emitted from the LED 20 can be allowed to enter the transparent FPC board 1 and accordingly the key portions 10 can be suitably irradiated.

As such, according to the present embodiment, a switch module including an LED can be provided which is capable of achieving slimming down and a sufficient click feeling and suitably irradiating key portions, while suppressing manufacturing cost.

[Second Embodiment]

Figure 1B:
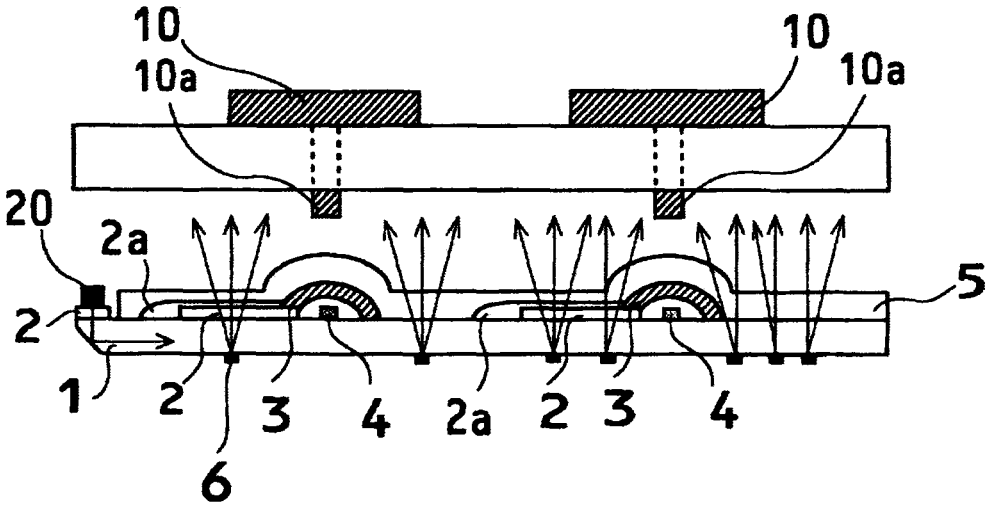

A switch module according to a second embodiment of the present invention will be described with reference to FIG. 1B. FIG. 1B is a schematic cross-sectional view of a switch module according to the present embodiment. Note that description of the same components as those in the first embodiment will not described here.

<2-1: Transparent Protective Film that Protects Wiring Lines>

The present embodiment is characterized in that the surfaces of transparent conductive films 2 are covered with transparent protective films 2*a* (transparent protective members). The transparent protective films 2*a* are formed on the transparent conductive films 2 by performing processing such as lamination, transfer, or printing on an insulating material with high transparency. With this configuration, the transparent conductive films 2 can be mechanically protected from contact, shock, etc., and thus, the durability of the switch module is improved.

In addition, since the protective films 2*a* are transparent, light reflected from reflecting portions 6 is not blocked by the transparent protective films 2*a*. Thus, without causing a reduction in the amount of light, key portions 10 can be suitably irradiated and the number of LEDs 20 can be reduced, and thus, a reduction in manufacturing cost and power consumption can be achieved.

As such, according to the present embodiment, a switch module including an LED can be provided which is capable of achieving slimming down and a sufficient click feeling and suitably irradiating key portions, while suppressing manufacturing cost.

[Third Embodiment]

Figure 2A:
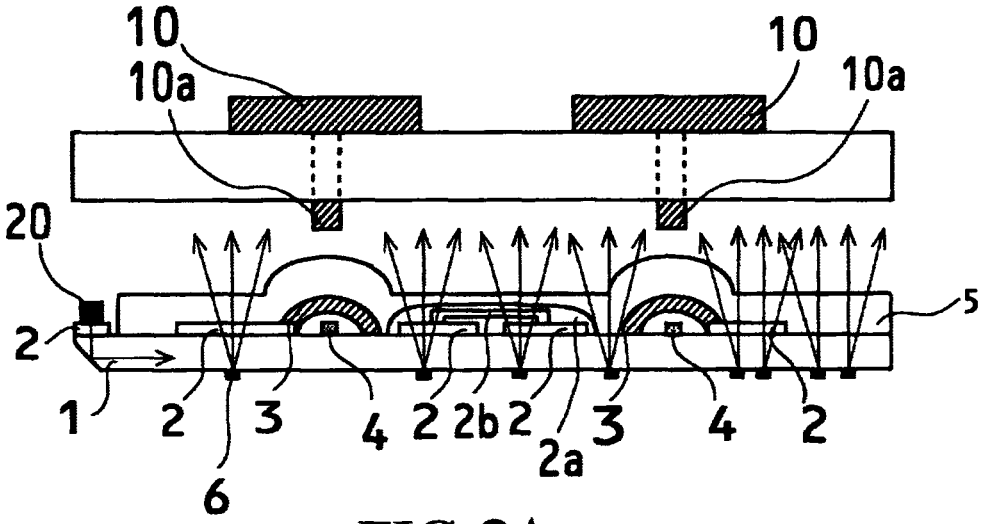
FIGS. 2A and 2B are schematic cross-sectional views of switch modules according to third and fourth embodiments of the present invention.

A switch module according to a third embodiment of the present invention will be described with reference to FIG. 2A. FIG. 2A is a schematic cross-sectional view of a switch module according to the present embodiment. Note that description of the same components as those in the first and second embodiments will not described here.

<3-1: Jumper Connection by a Transparent Conductive Film>

The present embodiment is characterized in that transparent conductive films 2 serving as wiring lines are jumper-connected on a transparent FPC board 1. FIG. 2A shows a state in which the transparent conductive films 2 are not all covered with transparent protective films 2*a*, and opening portions of transparent conductive films 2 which are partially formed are electrically connected by a jumper connection 2*b* by means of a transparent conductive film.

With this configuration, even when complex wiring lines are required such as two-layer wiring lines, such a case can be coped with by connecting the wiring lines by a transparent conductive film. Note that although the amount of irradiated light may partially decrease due to two-layer wiring lines, in general, the wiring area of the two-layer wiring lines is very small, and thus, the amount of irradiated light of the switch module as a whole can be maintained at a satisfactory level.

Note that although a technique for implementing two-layer wiring lines by making through-holes in a board to form a double-sided structure is conventionally known, the above-described jumper connection is more desirable in terms of processing and connection reliability.

As such, according to the present embodiment, a switch module including an LED can be provided which is capable of achieving slimming down and a sufficient click feeling and suitably irradiating key portions, while suppressing manufacturing cost.

[Fourth Embodiment]

Figure 2B:
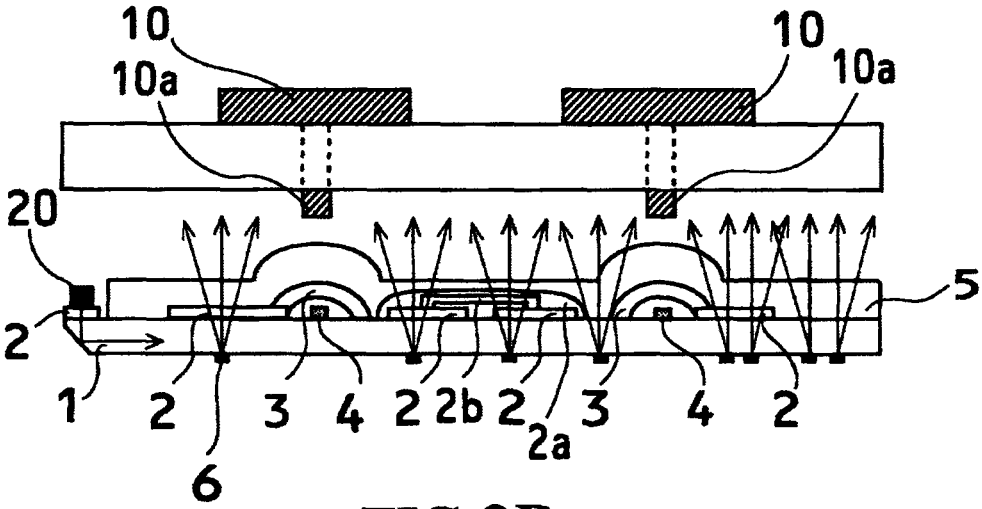

A switch module according to a fourth embodiment of the present invention will be described with reference to FIG. 2B. FIG. 2B is a schematic cross-sectional view of a switch module according to the present embodiment. Note that description of the same components as those in the first to third embodiments will not described here.

<4-1: Application of Polydomes>

In the first to third embodiments, the configuration is described in which "metal domes" are used as deformable and conductive switch members. The present embodiment, on the other hand, is characterized in that switch members are configured by transparent polydomes (transparent members) where transparent wiring lines are formed.

With this configuration, since the light transmittance is significantly improved over the case of using metal domes, the amount of light irradiated onto key portions 10 can be increased without increasing the number of LEDs 20. Thus, without causing a reduction in the amount of light, the key portions 10 can be suitably irradiated and the number of LEDs 20 can be reduced, and thus, a reduction in manufacturing cost and power consumption can be achieved.

Polydomes 3 may be formed of PET (polyethylene terephthalate), polycarbonate, etc., in terms of transparency and mechanical strength. In addition, the above-described transparent conductive films may be formed on all surfaces of the polydomes 3, as transparent wiring lines.

As such, according to the present embodiment, a switch module including an LED can be provided which is capable of achieving slimming down and a sufficient click feeling and suitably irradiating key portions, while suppressing manufacturing cost.

[Fifth Embodiment]

Figure 3A:
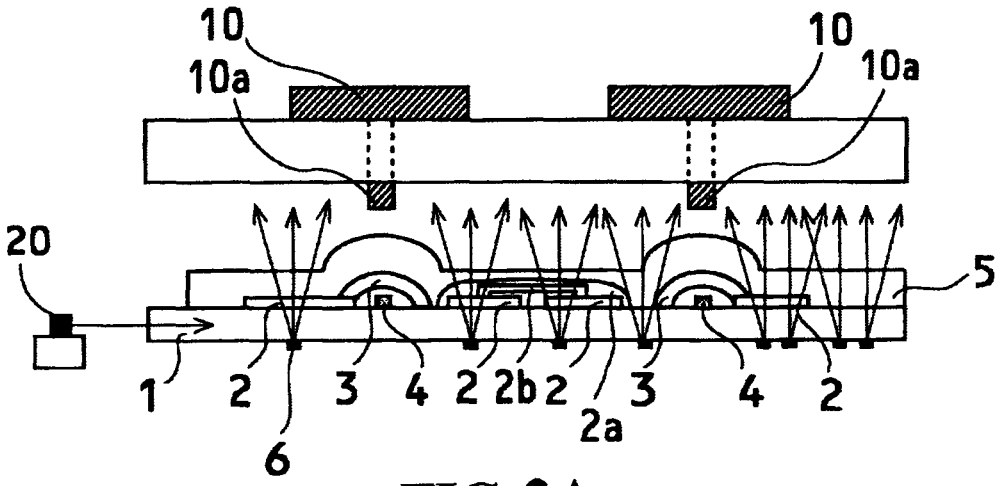
FIGS. 3A and 3B are respectively a schematic cross-sectional view of a switch module according to a fifth embodiment of the present invention and a diagram for describing the definition of a click rate.
Figure 3B:
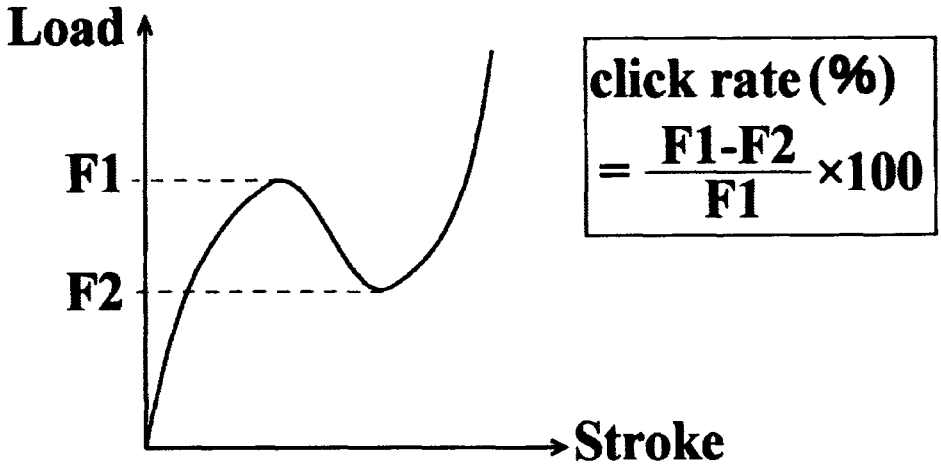

A switch module according to a fifth embodiment of the present invention will be described with reference to FIG. 3A. FIG. 3A is a schematic cross-sectional view of a switch module according to the present embodiment. Note that description of the same components as those in the first to fourth embodiments will not described here.

<5-1: Formation of an LED 20 on a Different Board>

In the first to fourth embodiments, the case is described in which an LED 20 is disposed on a transparent FPC board 1 having formed thereon reflecting portions, 6, transparent conductive films 2, metal domes 3 (or polydomes 3), etc. However, the configuration may be such that the LED 20 is disposed on a different board than the transparent FPC board 1.

With this configuration, by disposing the LED 20 which requires high positioning accuracy on a different board than the transparent FPC board 1, an adjustment to the position of the LED 20 can be easily made upon assembling a portable device. Hence, variations and a reduction in yield caused by mounting tolerances can be absorbed and thus a reduction in manufacturing cost can be achieved. Note that the different board where the LED 20 is disposed does not need to be a transparent board.

As such, according to the present embodiment, a switch module including an LED can be provided which is capable of achieving slimming down and a sufficient click feeling and suitably irradiating key portions, while suppressing manufacturing cost.

What is claimed is:

1. A switch module disposed to face a key portion, the switch module comprising:

a board disposed to face the key portion;

a wiring line formed on a side of the board that faces the key portion;

an electrode provided on the side of the board that faces the key portion;

a conductive switch member that is in contact with a part of the wiring line on the board and that is allowed to come into contact with the electrode by being deformed; and a light source element that emits light, the electrode and the wiring line being electrically connected to each other by the key portion coming into contact by pressure with the switch member and the switch member being thereby deformed to come into contact with the electrode, wherein the board is a flexible printed circuit board that is formed of a transparent material and is operable as a light guide, a plurality of reflecting portions are formed on a surface of the board on the opposite side to the side facing the key portions, and light emitted from the light source element and guided in a direction orthogonal to a thickness direction of the board in the board is irregularly reflected by the reflecting portions provided on the board, in a direction of the key portion.

2. The switch module according to claim 1, wherein the wiring line is a transparent wiring line formed on the board by a printing method.

3. The switch module according to claim 1, wherein on the board, the wiring line is covered with a transparent protective member.

4. The switch module according to claim 1, wherein the switch member is formed of a deformable transparent member where a transparent wiring line which is connected to a part of the wiring line is formed.

5. The switch module according to claim 1, wherein on the board, at least a side of the switch member that faces the key portion is covered with a transparent protective member.

6. The switch module according to claim 1, wherein the light source element emits light in the thickness direction of the board from a front surface of the board, and reflection processing is performed on the board to allow the light emitted from the light source element to be reflected in the direction orthogonal to the thickness direction of the board.

7. The switch module according to claim 1, wherein the light source element is provided on a different board than the board.

8. The switch module according to claim 1, wherein a distance between adjacent reflecting portions decreases as a distance from the light emitting element increases.

* * * * *